US010877425B2

(12) United States Patent
Li et al.

(10) Patent No.: US 10,877,425 B2
(45) Date of Patent: Dec. 29, 2020

(54) FLUID APPLICATION DEVICES WITH RESISTIVE COATINGS

(71) Applicant: HP Indigo B.V., Amstelveen (NL)

(72) Inventors: Guang Jin Li, San Diego, CA (US); Daniel Tanchangco, San Diego, CA (US); Eyal Negreanu, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/617,550

(22) PCT Filed: Jun. 27, 2017

(86) PCT No.: PCT/US2017/039406
§ 371 (c)(1),
(2) Date: Nov. 27, 2019

(87) PCT Pub. No.: WO2019/005005
PCT Pub. Date: Jan. 3, 2019

(65) Prior Publication Data
US 2020/0142347 A1 May 7, 2020

(51) Int. Cl.
*G03G 21/00* (2006.01)

(52) U.S. Cl.
CPC ..... *G03G 21/0094* (2013.01); *G03G 21/0058* (2013.01)

(58) Field of Classification Search
CPC ..... G03G 9/13; G03G 9/125; G03G 13/10; G03G 15/10; G03G 15/11; G03G 15/0818; G03G 2215/0658; G03G 2215/0861
USPC ..... 399/107, 110, 111, 119, 120, 222, 237, 399/239, 241, 249, 348, 346
See application file for complete search history.

(56) References Cited

U.S. PATENT DOCUMENTS

| | | | | |
|---|---|---|---|---|
| 7,177,572 | B2 | 2/2007 | DiRubio et al. | |
| 7,664,437 | B2 * | 2/2010 | Kellie | G03G 15/065 399/237 |
| 8,440,379 | B2 * | 5/2013 | Roditi | C09D 11/037 430/109.1 |
| 8,588,655 | B2 | 11/2013 | Berg | |
| 8,792,796 | B2 | 7/2014 | Kella et al. | |
| 9,423,717 | B2 | 8/2016 | Chang et al. | |
| 9,535,363 | B2 * | 1/2017 | Schlumm | G03G 15/0184 |
| 9,546,286 | B2 | 1/2017 | Step et al. | |
| 2011/0279616 | A1 | 11/2011 | Bailey et al. | |
| 2017/0066259 | A1 | 3/2017 | Tamaki et al. | |

FOREIGN PATENT DOCUMENTS

WO WO-2016018379 A1 2/2016

OTHER PUBLICATIONS

Anthony, Thomas C., et al. "ElectroInk Charge Retention in the HP Indigo LEP Press." In NIP & Digital Fabrication Conference, vol. 2012, No. 2, pp. 502-502. Society for Imaging Science and Technology, 2012.

* cited by examiner

*Primary Examiner* — Hoan H Tran
(74) *Attorney, Agent, or Firm* — Fabian VanCott

(57) ABSTRACT

In one example in accordance with the present disclosure, a fluid application device is described. The device includes an application roller to deposit a fluid containing metallic particles on a surface. A squeegee roller of the device forms a first nip with the roller and a cleaner roller forms a second nip with the application roller. A first resistive coating is disposed on a surface of the application roller.

14 Claims, 4 Drawing Sheets

FLUID APPLICATION DEVICES WITH RESISTIVE COATINGS

BACKGROUND

Fluid application devices are used to deposit fluid compounds on a surface. For example, in a printing application, ink is deposited on a substrate, such as paper to form printed images and/or text. A fluid application device in the printer is used, in conjunction with other components, to deposit solid particles within the fluid on the substrate in a designated pattern.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
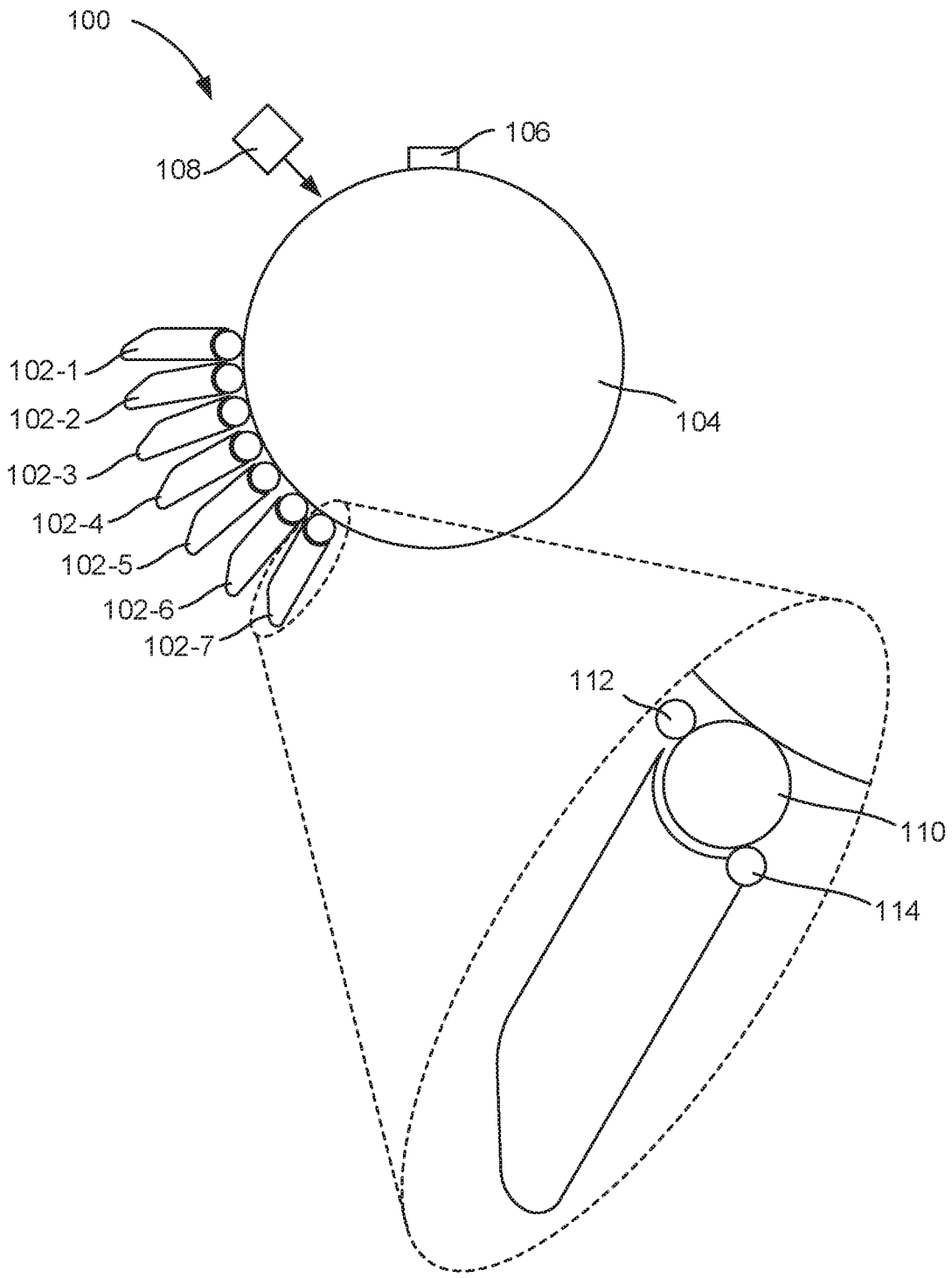
FIG. 1 is a diagram of a fluid application system with fluid application devices with resistive coatings, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluid application devices are used to deposit fluid compounds on a surface. For example, in a printing application, ink is deposited on a substrate, such as paper to form printed images and/or text. A fluid application device in the printer is used, in conjunction with other components, to deposit the fluid on the substrate in a designated pattern.

One specific example of a printing system is a liquid electrophotographic printer. In an electrophotographic printer, a photoconductive plate is disposed around a rotating drum. As the drum rotates, a charging roller places a uniform static electric charge on the surface of the photoconductive plate. In some cases, the photoconductive plate is negatively charged by the charging roller. As the photoconductive plate continues to rotate, it passes by an imaging unit that dissipates portions of the negative charge on certain areas on the photoconductive plate in a patter. Accordingly, an electrostatic patter, i.e., a latent image, in the pattern of text and/or images to be formed on the substrate is formed on the photoconductive plate. While specific reference is made to a rotating drums, other configurations are possible as well, including rotating belts.

A number of fluid application devices then deposit charged fluid on the surface of the photoconductive drum in the pattern of the latent image. That is, particles within the fluid carry an electrical charge such that the fluid is attracted to the photoconductive plate. A single printing system may include any number of fluid application devices. For example, the different fluid application devices may correspond to different colors, or different types of fluids to be ejected. Following deposition of electrically charged fluid particles on the electrically charged photoconductive drum, the fluid particles are then transferred to any number of intermediate rollers to be ultimately deposited on the substrate surface.

The present disclosure describes fluid application devices that facilitate the deposition of fluid containing metallic particles onto the substrate surface. An example of such a fluid that contains metallic particles is metallic ink. Printing with metallic ink may be desirable to produce previously unavailable colors via fluid deposition. For example, some manufacturer labels may be metallic-colored. Another example is food packaging, which may include metallic surfaces. As a specific example, an exterior of a chip bag may have printed material and the interior may be a metallic surface. In another example, metallic colors are used on high-end labels. Previous methods of providing metallic-colored surfaces raise several complications. For example, ink may be printed on a metallic media, which metallic media is expensive. Accordingly, the present specification describes a printing system, which in addition to depositing fluids such as pigmented ink, can also deposit metallic fluids such as metallic ink.

Specifically, the present specification describes a fluid application device. The fluid application device includes an application roller to deposit a fluid containing metallic particles on a surface. A squeegee roller of the fluid application device forms a first nip with the application roller and condenses the fluid containing metallic particles on the application roller. A cleaner roller forms a second nip with the application roller and removes excess fluid not deposited on the surface. A first resistive coating is disposed on a surface of the application roller.

The present specification also describes a fluid application device. The fluid application device includes an application roller to deposit a fluid containing metallic particles on a surface via electrostatic attraction. A squeegee roller forms a first nip with the application roller. The squeegee roller condenses the fluid on the application roller via electrostatic attraction. A cleaner roller forms a second nip with the application roller. The cleaner roller removes excess fluid from the application roller via electrostatic attraction. A first resistive coating is disposed on a surface of the application roller to maintain an electrical field at the first nip and the second nip, a second resistive coating is disposed on a surface of the squeegee roller to maintain an electrical field at the first nip, and a third resistive coating is disposed on a surface of the cleaner roller to maintain an electrical field at the second nip.

The present specification also describes a fluid application system. The fluid application system includes a photoconductive plate to transfer an ink image formed thereon to a media substrate, an image-forming device to form an electrostatic pattern on the photoconductive plate, and multiple fluid application devices to deposit ink on the photoconductive plate based on the electrostatic pattern. Each fluid application device includes an application roller to deposit the ink, which ink contains metallic particles, on the photoconductive plate; a squeegee roller that forms a first nip with the application roller; and a cleaner roller that forms a second nip with the application roller. A resistive coating is disposed on a surface of the application roller to maintain an electrical field at the first nip and the second nip.

Such devices and systems facilitate printing with metallic ink and other fluids that contain metallic particles. For example, in printing systems, there may be gaps between the aforementioned rollers. As some of the rollers are formed of metal or other conductive material, a short can disrupt the electrical field that is the basis for electrophotographic printing. Printing with metallic flakes is a process that may be prone to such electrical shorts. For example, to generate a metallic appearance, metallic flakes in the metallic ink are flat and large, up to 20 micrometers. Accordingly, they can be much bigger than particles used in pigment-based inks. As these metallic particles in fluid 1) are larger than pigment particles in fluid and 2) are electrically conductive, the metallic particles may bridge the gap between adjacent rollers, where pigment particles may not bridge the gap. Due to the conductivity of metal, these large metallic particles that bridge the gaps may form an electrical path between adjacent rollers leading to shorting, disruption of the electrical fields that facilitate the transfer of the metallic particles within the printing system, and/or causing power supply failures due to high electrical current.

Accordingly, the resistive coating on at least the application roller prevents such electrical shorts while maintaining the electric field that allows transfer of metallic particles during the print operation. The resistive coating may allow for fluid application devices to be used in printing systems that also deposit pigment ink. That is, an individual fluid application device may be removable from a system. At one point in time, pigment-based fluid application devices may be installed in the system, which pigment-based fluid application devices do not include resistive coatings. At another point in time, metallic-based fluid application devices, which metallic-based fluid application devices include resistive coatings on some of the rollers, can be inserted into the system to facilitate depositing metallic inks or other metal-containing fluid. In other words, one printing system can be used 1) to deposit pigment-based fluids and 2) to deposit metal-based fluids, by interchanging the fluid application devices within the printing system.

In summary, using such a fluid application device 1) allows printing with metallic ink, 2) maintains sufficient and consistent electric fields to ensure high-quality and reliable fluid deposition, and 3) enables higher voltages on the squeegee and cleaner voltages to enhance performance of the fluid application devices. However, it is contemplated that the devices disclosed herein may address other matters and deficiencies in a number of technical areas.

As used in the present specification and in the appended claims, the term "fluid application device" refers to a device that applies a fluid to a surface. For example, a binary ink developing (BID) unit that deposits ink on a photoimaging plate (PIP) is one example of a fluid application device.

Still further, as used in the present specification and in the appended claims, the term "fluid" refers to a liquid-based formulation that is deposited on a surface. In one specific example, the fluid is an ink that contains a mixture of solid ink particles and liquids. In this example, what is eventually left on the media is mostly solid ink particles.

Even further, as used in the present specification and in the appended claims, the term "metallic ink" refers to an example of a fluid that contains metallic particles. As a specific example, metallic ink may include metallic flakes, such as aluminum copper, or silver, and other components such as polymer resin and additives. In some examples, a percentage of metallic flakes in the compound may be 30%. In this example, the metallic flakes are ultimately deposited on the media to form an image and/or text.

Further, as used in the present specification and in the appended claims, the term "a number of" or similar language is meant to be understood broadly as any positive number including 1 to infinity.

FIG. 1 is a diagram of a fluid application system (100) with fluid application devices (102) with resistive coatings, according to an example of the principles described herein. As described above, the fluid application system (100) facilitates the deposition of a fluid, such as ink, on a surface, such as paper. The fluid deposited on the substrate may be of varying types. For example, the fluid may be a metallic ink, or another fluid that includes metal particles. Depositing a fluid with metal particles may be desirable at least as it 1) provides a wider variety of printing operations and 2) increases the color gamut of what can be printed. For example, it may be desirable to print a metallic color, such as silver. In previous methods, to achieve such an outcome, a metallic substrate may be used rather than printing a metallic color on a non-metallic substrate. However, this metallic material can be expensive and may include other properties that make it undesirable for particular projects. Moreover, processing metallic material can rely on expensive and specialized machinery. Still further, printing with metallic ink provides printing, or fluid deposition operations, to new industries. Using the fluid application system (100) described herein, standard printing operations can be used to achieve the same end result.

Still further, using fluids containing metallic particles, printing operations can be expanded. For example, by using metallic inks, a sheen can be formed on pigment-based products. In this example, a pigment-based ink could be deposited over the metallic ink to produce an image, but with additional sheen provided by the underlying metallic ink.

As will be described below, the fluid application system (100) includes fluid application devices (102) that may be removable. As described above, in one specific example, the fluid application devices (102) are binary ink developing (BID) units that deposit ink on a photoconductive plate. The fluid application devices (102) that accommodate printing with metallic ink increase the capabilities of the fluid application system (100). That is, in one application, fluid application devices (102) that deposit pigment-based ink can be installed. At another point in time, fluid application devices (102) that facilitate metallic printing can be installed. Thus one fluid application system (100), which may be found in a printer, can be used to both print with pigment-based ink and with metallic ink.

The fluid application system (100) includes a photoconductive plate (104). The photoconductive plate (104) is disposed around a drum and is used to transfer an image formed thereon to a media substrate. For example, once an image is formed on the photoconductive plate (104), the image is transferred either directly to the substrate or through a series of intermediate rollers to be ultimately deposited on the substrate.

The fluid application system (100) includes a number of components to form the image on the photoconductive plate (104). Specifically, the fluid application system (100) includes an image-forming device to form an electrostatic pattern on the photoconductive plate (104). The image-forming device includes a charging roller (106) that distributes a uniform static charge across a surface of the photoconductive plate (104). Specifically, as the photoconductive plate (104) rotates, it comes into contact with the charging roller (106) which directs negatively charged particles onto the photoconductive plate (104). Next, a laser (108), or other energy-emitting source, dissipates portions of the previously applied static charge on the photoconductive plate (104). This dissipation is done to form patterns, which patterns define the images and/or text that are desired to be printed on the substrate. In summary, after passing by the charging roller (106) and the laser (108) an electrostatic latent image is formed on the photoconductive plate (104) conforming to the image and/or text to be printed.

The fluid application system (100) also includes multiple fluid application devices (102-1, 102-2, 102-3, 102-4, 104-5, 102-6, 102-7). The fluid application devices (102) deposit ink or other fluid on a surface, such as the photoconductive plate (104), based on the electrostatic latent image formed on the photoconductive plate (104). That is, each fluid application device (102) contains fluid that is electrically charged and is attracted to the electrostatic pattern formed on the photoconductive plate (104). Accordingly, as different fluid application devices (102) are moved into contact with the photoconductive plate (104), electrically charged fluid particles, such as pigment ink or metallic ink, are attracted to the electrostatic pattern on the photoconductive plate (104). The desired image is then transferred, either directly or indirectly, onto the substrate.

Once a particular fluid application device (102) has deposited its fluid on the surface according to the pattern and that fluid has been transferred to the substrate, the above described cycle repeats for subsequent fluid application devices (102). That is, the fluid application system (100) goes through different cycles of image forming and fluid deposition for each fluid application device (102) until a desired image, which may include different colors, is formed on the substrate. While FIG. 1 depicts seven fluid application devices (102), any number of fluid application devices (102) may be implemented in accordance with the principles described herein.

The fluid application devices (102) contain different fluids that are to be deposited on the substrate. For example, each fluid application device (102) may include a different color ink. At least one of the fluid application devices (102) may include metallic ink. In one specific example, at least one of the fluid application devices (102) may include a pigment-based ink and another fluid application device (102) may include a metallic ink. That is, the fluid application system (100) as described herein may simultaneously contain a pigment-based fluid application device (102) and a metallic fluid-based fluid application device (102). It should be noted, that in some examples, the fluid application devices (102) are removable from the fluid application system (100). That is, as fluid within the fluid application device (102) is depleted, or to carry out a different printing operation, the fluid application devices (102) can be removed and replaced with other fluid application devices (102).

To deposit the fluid contained therein, each fluid application device (102) includes a number of components. First, each fluid application device (102) includes an application roller (110). The application roller (110) deposits the fluid, such as metallic ink, on to the photoconductive plate (104). That is, fluid from within a fluid reservoir in the fluid application device (102) is deposited on the photoconductive plate (104). In some cases, fluid, supplied by a reservoir, is transferred from the fluid application device (102) to the application roller (110) via electrostatic forces.

A squeegee roller (112) forms a first nip with the application roller (110) and condenses the fluid. That is, fluids with metallic particles, or metallic inks, include carrier fluid, metallic particles, and other additives. As the ink is deposited on the application roller (110), the metallic particles may form 2-3% of the fluid. The squeegee roller (112), via pressure and electrostatic attraction, condenses the fluid such that the fluid, after operation by the squeegee roller (112) contains between 20-30% solids on the application roller (110) to be ultimately selectively transferred on the photoconductive plate (104) based on the latent image on the photoconductive plate (104).

A cleaner roller (114) of the fluid application devices (102) forms a second nip with the application roller (110) and remove excess fluid, including metallic particles from the application roller (110). That is, after metallic particles have been deposited on an image area of photoconductive plate (104), there may be some residual fluid left on the application roller (110). To ensure proper development of a uniform layer of subsequently applied metallic ink to the application roller (110), the application roller (110) is cleaned off by the cleaner roller (114).

The fluid application system (100) as described herein allows for the deposition of different types of fluid, i.e., pigment-based ink and metallic ink, all using the same fluid application system (100) by simply incorporating different fluid application devices (102) into the system (100). As will be described in FIG. 2, some of the fluid application devices (102) include components that facilitate high-quality efficient deposition of fluid containing metallic particles, which efficient deposition expands the printing capabilities of the fluid application system (100) to include printing metallic colors.

Figure 2:
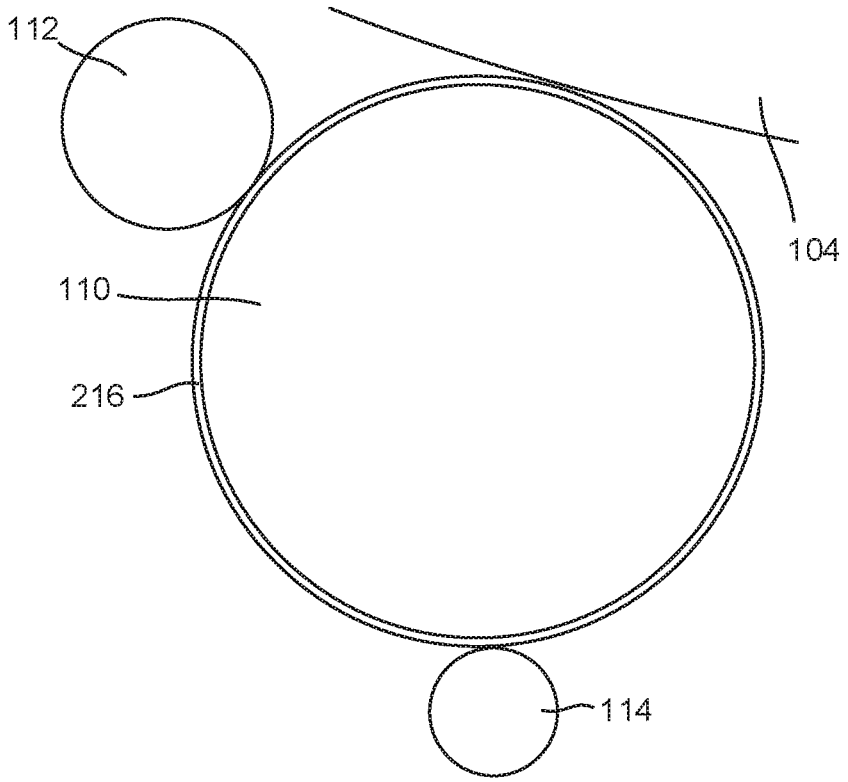
FIG. 2 is a diagram of a fluid application device with a resistive coating on one roller, according to an example of the principles described herein.

FIG. 2 is a diagram of a fluid application device (FIG. 1, 102) with a resistive coating (216) on one roller, according to an example of the principles described herein. Specifically, FIG. 2 depicts a resistive coating (216) disposed on the application roller (110) of the fluid application device (FIG. 1, 102). That is, the fluid application device (FIG. 1, 102) includes 1) an application roller (110) to deposit a fluid containing metallic particles on a surface, 2) a squeegee roller (112) forming a first nip with the application roller (110) which first nip is upstream of the surface on which the metallic particles are deposited, i.e., the photoconductive plate (104), and 3) a cleaner roller (114) forming a second nip with the application roller (110), which second nip is formed downstream of the surface on which the metallic particles are disposed, i.e., the photoconductive plate (104). The application roller (110) includes a first resistive coating (216) disposed thereon.

The resistive coating (216) facilitates effective and efficient printing with metallic ink or other fluid containing metallic particles. For example, various operations of the fluid application device (FIG. 1, 102) are based on electrostatic attraction. A specific example is provided as follows.

In this example, negatively charged metallic particles within the fluid are attracted to an electrostatically charged application roller (110). The squeegee roller (112), which may have a more negative charge than the application roller (110), draws the carrier out of the fluid, while repelling the metallic particles towards the application roller (110). During application, the charged particles are attracted to image areas of the photoconductive plate (104) and repelled from the application roller (110) based on the photoconductive plate (104) being less negatively charged than the application roller (110). Still further, the cleaner roller (114) being less negatively charged than the application roller (110), draws the particles away from the application roller (110), thus cleaning it. It is also noted that there may be a gap between each of the rollers, i.e., the application roller (110) and the squeegee roller (112), the application roller (110)

and the photoconductive plate (104), and the application roller (110) and the cleaner roller (114).

When printing with metallic ink, the metallic flakes may be large, on the order of 1-30 micrometers, and may be flat and thin. These metallic flakes are also electrically conductive. In some cases, the flakes are sufficiently large to bridge the gap between the rollers. In so doing, the flakes can cause electrical shorts that disrupt the electrical fields between adjacent rollers, which can have a number of impacts. For example, to control the electrical field in a fluid application device (FIG. 1, 102), i.e., (BIDS), individual high voltage power supplies are used to control voltages of the application roller (110), squeegee roller (112), and cleaner roller (114), which rollers may be metallic. By creating a short between rollers, a high current is induced which can overwhelm the power supply causing failure of the power supply.

In another specific example, such electrical shorts impact image quality. For example, as described above, the photoconductive plate (104) includes electrical fields in some areas that attract particles, and includes electrical fields in other areas that repel particles. When an electrical field is dispersed via an electrical short between the application roller (110) and the photoconductive plate (104), these electrical fields dissipate, thereby reducing the ability of the photoconductive plate (104) to either attract or repel metallic particles within the fluid. The result is a lack of selectivity of fluid transfer. For example, fluid may be transferred to blank areas intended to contain no image and less than a desired quantity of fluid may be transferred to image areas intended to contain an image Accordingly, the resistive coating (216) provides a barrier to such electrical shorts. Now, instead of a conductive roller, a resistive roller is provided which prevents shorts, and thereby prevents power supply overload and maintains electrical fields long enough to facilitate fluid transfer.

The resistive coating (216) also allows for higher voltages to be applied to the squeegee roller (112) and the cleaner roller (114). A higher voltage applied to these rollers increases the electrical field between them and the application roller (110), which enhances the ability of the squeegee roller (112) to condense the metallic fluid and enhances the ability of the cleaner roller (114) to remove excess fluid from the application roller (110).

The resistive coating (216) disposed on the application roller (110) may be a polymer-based layer that is applied via spray coating. The thickness of the resistive coating (216) may be selected based on desired application. For example, the resistive coating (216) on the application roller (110) may be between two and twenty micrometers thick and may have a resistivity of between $3.3\times10^{9}$ and $3.3\times10^{12}$ ohms centimeter.

Figure 3:
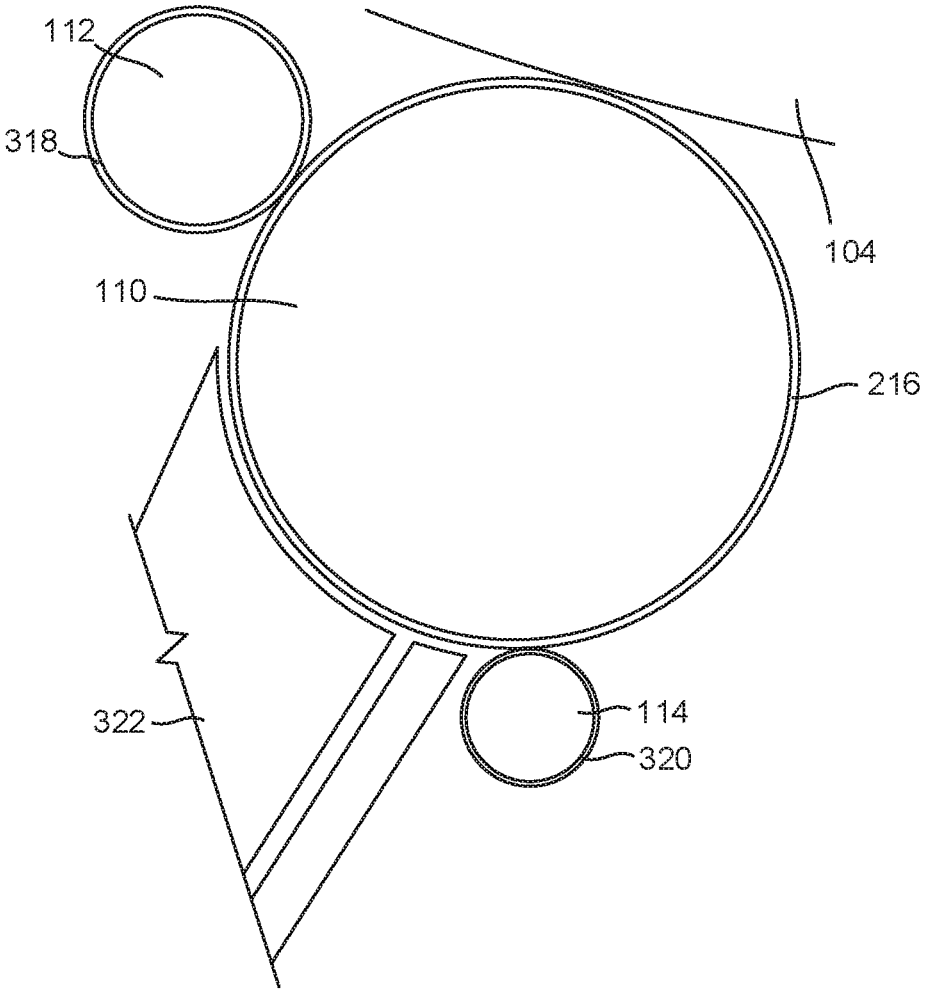
FIG. 3 is a diagram of a fluid application device with resistive coatings on multiple rollers, according to an example of the principles described herein.

FIG. 3 is a diagram of a fluid application device (FIG. 1, 102) with resistive coatings (216, 318, 320) on multiple rollers, according to an example of the principles described herein. Specifically, FIG. 3 depicts a first resistive coating (216) on the application roller (110), a second resistive coating (318) disposed on a surface of the squeegee roller (112), and a third resistive coating (320) disposed on a surface of the cleaner roller (114). As described above, a resistive coating serves to protect against electrical short, and additional resistive coatings enhance this effect. In some examples, the resistive coatings may be different from one another. Specifically, the first resistive coating (216) may be formed of a material having a thickness and resistivity that is different from the second resistive coating 318) and the third resistive coating (320). The second and third resistive coatings (318, 320) may be similar to one another. These differences and similarities are based on the differences between the corresponding rollers. For example, the application roller (110) may be formed of a conductive rubber. Accordingly, the resistive coating may be a polymer-based layer that is sprayed on. The squeegee roller (112) and the cleaner roller (114) are metal rollers. Accordingly, the second resistive coating (318) and the third resistive coating (320) may be semi-conductive ceramics, which are applied via plasma spray.

Another distinction between the first resistive coating (216) and the others is a coating thickness. As described above, the first resistive coating (216) may be between 2 and 20 micrometers thick. By comparison, the second resistive coating (318) and the third resistive coating (320) may be between 10 and 500 micrometers thick.

Another distinction between the first resistive coating (215) and the others is a coating resistivity. More specifically, the first resistive coating (216) may be more resistive than the second resistive coating (318) and the third resistive coating (320) which may have the same resistivity. Specifically, the first resistive coating (216) may have a resistivity of between $3.3\times10^{9}$ and $3.3\times10^{12}$ ohms centimeter and the second resistive coating (318) and third resistive coating (320) may have a resistivity of between $1.5\times10^{5}$ and $7.5\times10^{9}$ ohm centimeters.

The fluid application device (100) also includes an electrode (322) to adhere the fluid to the application roller (110). For example, the application roller (110) may have an electrostatic charge that has a negative value. The electrode (322) may have a more negative electrostatic charge such that the metallic particles are repelled from the electrode (322) towards the application roller (110). Accordingly, the fluid application device (FIG. 1, 102) as described herein facilitates the effective transport of metallic ink, or other fluid having metallic particles, to a photoconductive plate (104) by maintaining electrical fields that facilitate charged fluid transfer and by preventing electrical shorts which could overload the power supply of the fluid application device (FIG. 1, 102) with an unexpectedly high current.

Figure 4A:
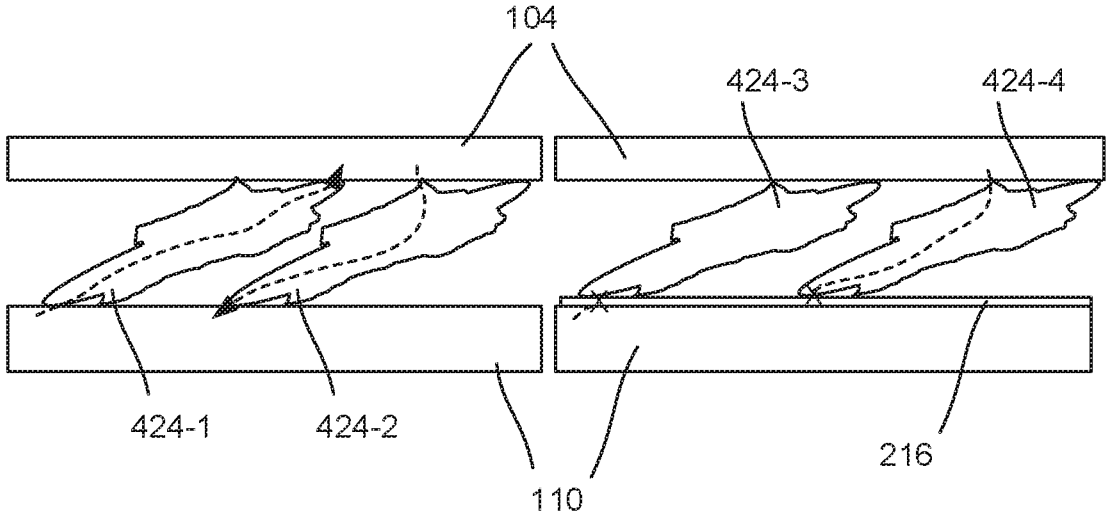
FIGS. 4A and 4B are zoomed-in diagrams of interfaces between rollers having resistive coatings, according to an example of the principles described herein.
Figure 4B:
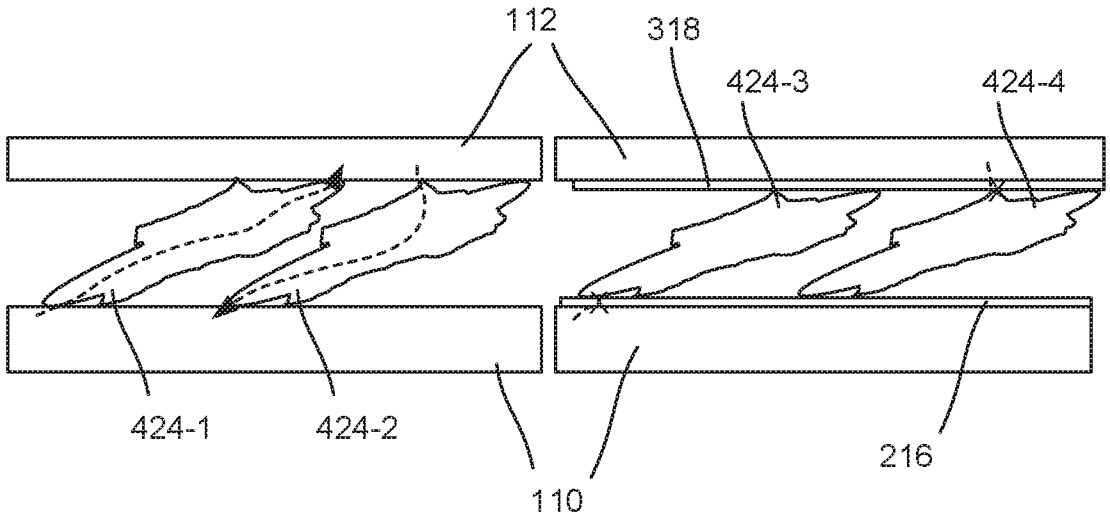

FIGS. 4A and 4B are zoomed-in diagrams of interfaces between various rollers having resistive coatings, according to an example of the principles described herein. Specifically, FIG. 4A is a zoomed-in diagram of an interface between a photoconductive plate (104) and an application roller (110) with and without the resistive coating (216) disposed over the application roller (110). As described above, there is a gap between the photoconductive plate (104) and the application roller (110). Due to their geometry and dimensions, the metallic particles (424) may bridge the gap. If no resistive coating (216) is in place, as indicated on the left hand side of FIG. 4A, these metallic particles (424) form electrical paths, which can disrupt the electrical fields between the photoconductive plate (104) and the application roller (110). Such electrical fields can either 1) attract the metallic particles (424) to the photoconductive plate (104) to form part of an image/text or 2) repel the metallic particles (424) away from the photoconductive plate (104) in areas of the image that are not to receive ink, i.e., background areas. Accordingly, the disruption of these fields can lead to metallic particles being undesirably placed on the background areas of the photoconductive plate (104), as they are not properly repelled, or may result in low optical density on image areas of the photoconductive plate, as they are not properly attracted.

By comparison, the right hand side of FIG. 4A depicts an interface between the photoconductive plate (104) and the application roller (110) that includes the first resistive coating (216). This first resistive coating (216) is formed of a material, and with such a resistivity, so as to prevent such electrical shorts, but not degrade the electrical field that repels and attracts metallic particles to various areas of the photoconductive plate (104).

FIG. 4B is a zoomed-in diagram of an interface between a squeegee roller (112) and an application roller (110) with and without the resistive coating (216) disposed over the application roller (110) and a second resistive coating (318) disposed over the squeegee roller (112). As described above, there is a gap between the squeegee roller (112) and the application roller (110). Due to their geometry and dimensions, the metallic particles (424), may bridge the gap. If no resistive coatings (216, 318) are in place, as indicated on the left hand side of FIG. 4A, these metallic particles (424) form electrical paths, which can cause a high current between the rollers. Such high current can overwhelm the power supply of the fluid application device (FIG. 1, 102).

By comparison, the right hand side of FIG. 4B depicts an interface between the squeegee roller (112) and the application roller (110) that includes the first resistive coating (216) and a second resistive coating (318). The first resistive coating (216) and the second resistive coating (318) are formed of a material, and with such a resistivity, so as to prevent such electrical shorts, but not degrade the electrical field that repels and attracts metallic particles to various areas of the squeegee roller (112).

In summary, using such a fluid application device 1) allows for printing with metallic ink, 2) maintains sufficient electric fields to ensure high-quality and reliable fluid deposition, and 3) enables higher voltages on the squeegee and cleaner voltages to enhance performance of the fluid application devices. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid application device comprising:
- an application roller to deposit a fluid containing metallic particles on a surface;
- a squeegee roller forming a first nip with the application roller;
- a cleaner roller forming a second nip with the application roller;
- a first resistive coating disposed on a surface of the application roller;
- a second resistive coating disposed on a surface of the squeegee roller; and
- a third resistive coating disposed on a surface of the cleaner roller.

2. The device of claim 1, wherein the surface is a photoconductive plate that transfers a fluid image onto a media substrate.

3. The device of claim 1, wherein the first resistive coating is more resistive than the second resistive coating and the third resistive coating.

4. The device of claim 1, wherein the second resistive coating has the same resistance as the third resistive coating.

5. The device of claim 1, further comprising an electrode to adhere the fluid containing metal particles to the application roller.

6. The device of claim 1, wherein a thickness of the first resistive coating is between two and twenty micrometers.

7. The device of claim 1, wherein a resistivity of the first resistive coating is between $3.3\times10^{9}$ and $3.3\times10^{12}$ ohms centimeter.

8. A fluid application device comprising:
- an application roller to deposit a fluid containing metallic particles on a surface via electrostatic attraction;
- a squeegee roller forming a first nip with the application roller, the squeegee roller to condense the fluid on the application roller via electrostatic attraction;
- a cleaner roller forming a second nip with the application roller, the cleaner roller to remove excess fluid from the application roller via electrostatic attraction;
- a first resistive coating disposed on a surface of the application roller to maintain an electrical field at the first nip and the second nip;
- a second resistive coating disposed on a surface of the squeegee roller to maintain an electrical field at the first nip; and
- a third resistive coating disposed on a surface of the cleaner roller to maintain an electrical field at the second nip.

9. The device of claim 8, wherein a thickness of the second resistive coating and the third resistive coating is between 10 and 500 micrometers thick.

10. The device of claim 8, wherein a resistivity of the second resistive coating and the third resistive coating is between $1.5\times10^{5}$ and $7.5\times10^{9}$ ohms centimeter.

11. The device of claim 8, wherein:
- the first nip is formed upstream of the surface on which the metallic particles are deposited; and
- the second nip is formed downstream of the surface on which the metallic particles are deposited.

12. The device of claim 8, wherein:
- a third resistive coating thickness and formulation are the same as a second resistive coating thickness and formulation; and
- a first resistive coating thickness and formulation is different from the second and third resistive coating thickness and formulation.

13. A fluid application system comprising:
- a photoconductive plate to transfer an ink image formed thereon to a media substrate;
- an image forming device to form an electrostatic pattern on the photoconductive plate; and
- multiple fluid application devices to deposit ink on the photoconductive plate based on the electrostatic pattern, wherein each of the fluid application devices includes:
  - an application roller to deposit the ink, which ink contains metallic particles, on the photoconductive plate;
  - a squeegee roller forming a first nip with the application roller;
  - a cleaner roller forming a second nip with the application roller;
  - a first resistive coating disposed on a surface of the application roller to maintain an electrical field at the first nip and the second nip;
  - a second resistive coating disposed on a surface of the squeegee roller; and
- a third resistive coating disposed on a surface of the cleaner roller.

14. The fluid application system of claim 13, wherein each of the fluid application devices is removable from the fluid application system.

* * * * *